US011465719B2

(12) United States Patent
Jemt

(10) Patent No.: US 11,465,719 B2
(45) Date of Patent: Oct. 11, 2022

(54) METHOD AND SYSTEM FOR FLUKE DRIVE

(71) Applicant: DOLPROP INDUSTRIES AB, Ekerö (SE)

(72) Inventor: Thomas Jemt, Ekerö (SE)

(73) Assignee: DOLPROP INDUSTRIES AB, Ekerö (SE)

( * ) Notice: Subject to any disclaimer, the term of this patent is extended or adjusted under 35 U.S.C. 154(b) by 0 days.

(21) Appl. No.: 17/289,156

(22) PCT Filed: Nov. 7, 2019

(86) PCT No.: PCT/SE2019/051120

§ 371 (c)(1),
(2) Date: Apr. 27, 2021

(87) PCT Pub. No.: WO2020/101553

PCT Pub. Date: May 22, 2020

(65) Prior Publication Data

US 2021/0387708 A1 Dec. 16, 2021

(30) Foreign Application Priority Data

Nov. 12, 2018 (SE) ..... 1851407-5

(51) Int. Cl.
*B63H 1/36* (2006.01)
*B63H 1/30* (2006.01)
*B63H 23/26* (2006.01)

(52) U.S. Cl.
CPC ..... *B63H 1/30* (2013.01); *B63H 1/36* (2013.01); *B63H 23/26* (2013.01)

(58) Field of Classification Search
CPC ... B63H 1/32; B63H 1/36; B63H 1/37; B63H 21/165; B63H 1/30; B63H 23/26
See application file for complete search history.

(56) References Cited

U.S. PATENT DOCUMENTS 12,446 A * 2/1855 Peale ..... B63H 1/36
416/82
23,112 A * 3/1859 Peters ..... B63H 1/36
440/14

(Continued)

FOREIGN PATENT DOCUMENTS

CN 106394843 A * 2/2017 ..... B63H 1/36
CN 106394843 A 2/2017

(Continued)

OTHER PUBLICATIONS

International Search Report from corresponding International Application No. PCT/SE2019/051120 dated Feb. 3, 2020, 4 pages.

*Primary Examiner* — Andrew Polay
(74) *Attorney, Agent, or Firm* — Tucker Ellis LLP

(57) ABSTRACT

Fluke drive system for a vessel (100), comprising a pivot element (114) having a forward end and an aft end, which pivot element (114) is pivotally connected at the forward end to a hull (101) of the vessel (100) and which pivot element (114) is connected at the aft end to a flexible fluke (125); a driving mechanism having a drive point (120), which driving mechanism is arranged to impart a reciprocal or rotary movement to the drive point (120); and a drive rod (121) having a first end and a second end, which drive rod (121) is connected at the first end to the drive point (120) and at the second end to the pivot element (114), which second end is connected to the pivot element (114) at a point (122) along the pivot element (114) between said forward and aft ends. The invention is characterized in that the driving mechanism comprises a carrier element (112) fastened to a propeller axle (111) of the vessel (100) and being arranged to rotate with the said propeller axle (111), and in that the said drive point (120) is excentrically arranged on the carrier element (112) so that a rotation of the propeller axle (111) will drive the drive rod (122) back and forth, in turn resulting in a (Continued)

reciprocal up and down motion of the flexible fluke (125). The invention also relates to a method.

15 Claims, 5 Drawing Sheets

(56) References Cited

U.S. PATENT DOCUMENTS

| | | | | |
|---|---|---|---|---|
| 1,148,434 | A | 7/1915 | Benedict | |
| 2,696,797 | A | 12/1954 | Whidden | |
| 8,684,777 | B2 | 4/2014 | Jemt | |
| 2011/0255971 | A1 | 10/2011 | Goris | |
| 2011/0287674 | A1* | 11/2011 | Jemt | B63H 16/12 440/15 |
| 2013/0178117 | A1* | 7/2013 | Baumann | B63H 1/36 440/14 |

FOREIGN PATENT DOCUMENTS

| | | | |
|---|---|---|---|
| KR | 20130079777 | A | 7/2013 |
| KR | 101758573 | B1 | 7/2017 |
| SU | 484129 | A1 | 9/1975 |

* cited by examiner

METHOD AND SYSTEM FOR FLUKE DRIVE

The present invention relates to a fluke drive system for a vessel, such as a floating vessel. In particular, the invention relates to such a system for use with such a vessel previously equipped with a propeller drive, and to a method for retrofitting such a vessel with such a fluke drive system. The solution according to the present invention is primarily useful for large vessels, the previously used propeller drive of which works at relatively low angular velocities.

Today, a relatively large proportion of the international transport system relies on large-scale freight ships, transporting large volumes of goods such as oil, foodstuffs and packaged products. For such transport, a major cost is fuel. Reducing fuel consumption is therefore of great concern for economic reasons, in addition to it being imperative for reducing the emission of carbon dioxide and other environmentally damaging compounds.

Another problem is the ecological damage imparted by the large propellers needed for such large vessels.

It has previously been described, such as in U.S. Pat. No. 8,684,777, how a dolphin fluke-shaped fin can be used to propel a floating vessel more efficiently and with less impact on the environment through which the vessel is propelled. Such a fin, which may be of different sizes and which may be the more or less the shape of a dolphin fluke, is hence herein denoted a "fluke".

However, to the knowledge of the present inventors there has not been presented an efficient way to provide fluke drive to a large vessel, such as a large-scale freight ship.

Such a solution should provide an efficient way to propel a large vessel, and also be possible to retrofit onto an existing vessel in a cost-efficient manner, maintaining full vessel security, stability and integrity.

An additional problem is to achieve a fluke design providing a highly efficient energy transfer at a relatively low reciprocal movement frequency, adapted for propelling a relatively large vessel using a relatively large fluke.

The present invention solves the above described problems.

Hence, the invention relates to a fluke drive system for a vessel, comprising a pivot element having a forward end and an aft end, which pivot element is pivotally connected at the forward end to a hull of the vessel and which pivot element is connected at the aft end to a flexible fluke; a driving mechanism having a drive point, which driving mechanism is arranged to impart a reciprocal or rotary movement to the drive point; and a drive rod having a first end and a second end, which drive rod is connected at the first end to the drive point and at the second end to the pivot element, which second end is connected to the pivot element at a point along the pivot element between said forward and aft ends, which system is characterized in that the driving mechanism comprises a carrier element fastened to a propeller axle of the vessel and being arranged to rotate with the said propeller axle, and in that the said drive point is eccentrically arranged on the carrier element so that a rotation of the propeller axle will drive the drive rod back and forth, in turn resulting in a reciprocal up and down motion of the flexible fluke.

Furthermore, the invention relates to a method for retrofitting a vessel with a fluke drive system, which method comprises the steps providing to the vessel a pivot element having a forward end and an aft end and being connected at the aft end to a flexible fluke, including connecting the pivot element at the forward end to a hull of the vessel; providing a driving mechanism having a drive point, which driving mechanism is arranged to impart a reciprocal or rotary movement to the drive point; and providing a drive rod having a first end and a second end, including connecting the drive rod at the first end to the drive point and at the second end to the pivot element, wherein the second end is connected to the pivot element at a point along the pivot element between said forward and aft ends, which method is characterized in that, in the said driving mechanism provision step, a carrier element is fastened to a propeller axle of the vessel so that it rotates with the said propeller axle, and in that, also in said driving mechanism provision step, the said drive point is eccentrically arranged on the carrier element so that a rotation of the propeller axle will drive the drive rod back and forth, in turn resulting in a reciprocal up and down motion of the flexible fluke.

In the following, the invention will be described in detail, with reference to exemplifying embodiments of the invention and to the enclosed drawings, wherein.

All FIGS. 1-7 are of principle character, and in general not drawn to scale.

Throughout this description, notions of direction, such as "up" or "down" relate, unless otherwise stated, to an operation state of the fluke driving system in which the fluke with a main fluke plane oriented substantially horizontally and the fluke moving reciprocally up and down vertically.

Figure 1:
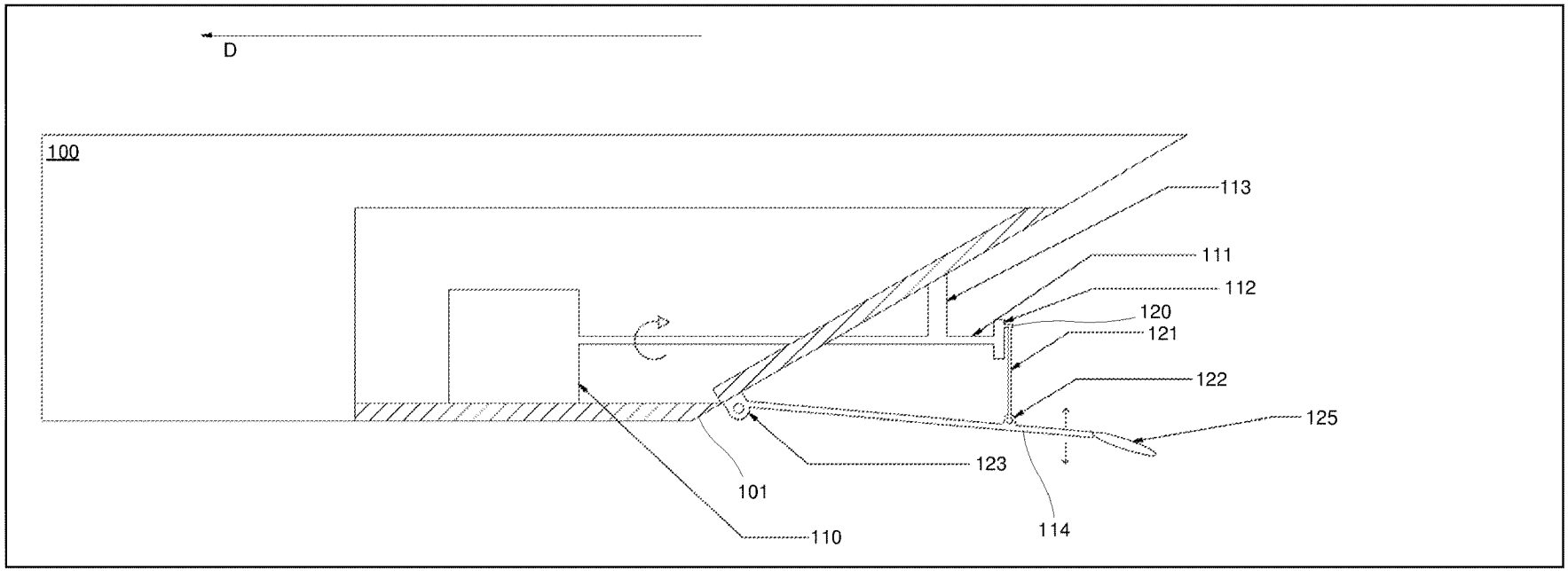
FIG. 1 is a simplified overview of a vessel having an exemplifying fluke drive system according to a first aspect of the present invention.

Hence, FIG. 1 illustrates a fluke drive system for a vessel 100 according to a first aspect of the present invention. The vessel 100 has a longitudinal direction D, where the arrow D in FIG. 1 points in a vessel 100 forward direction, opposite to a vessel 100 aft direction. It is realized that, in FIGS. 1 and 2, the vessel 100, 200 is illustrated in a longitudinal and vertical cross-section as seen from the side of the vessel 100, 200.

The said drive system of FIG. 1 comprises a pivot element 114, having a forward end and an aft end. At its forward end, the pivot element 114 is pivotally connected to a hull 101 of the vessel 100. At its aft end, the pivot element 114 is connected to a flexible fluke 125.

According to the present invention, the fluke 125 is forced to move reciprocally in the water below the water surface, upwards and downwards, and as a result give rise to a forward propulsion of the vessel 100. The corresponding is true regarding the fluke 229 in the embodiment illustrated in FIG. 2 in relation to vessel 200 (see below).

Furthermore, the drive system comprises a driving mechanism having a drive point 120. The driving mechanism is arranged to impart a reciprocal or rotary movement to the drive point 120, so that the fluke 125 is driven reciprocally upwards and downwards as a result of the driving of the drive point 120.

The drive system further comprises a drive rod 121, having a first end (upper end in FIG. 1) and a second end (lower end in FIG. 1).

The drive rod 121 is connected, at said first end, to the drive point 120. In other words, the said first end is connected to the drive point 120 such that the drive point 120 drives the first end when the drive point 120 moves as a result of said driving mechanism action.

The drive rod 121 is furthermore connected at said second end to the pivot element 114. In particular, the second end is connected to the pivot element 114 at a point 122 along the pivot element 114 between said forward and aft ends of said pivot element 114. This is clearly illustrated in the exemplifying embodiment shown in FIG. 1. The point 122 may also be a pivot point, as is seen in FIG. 1.

According to the present invention, the driving mechanism further comprises a carrier element 112, fastened to a propeller axle 111 of the vessel 100, which propeller axle 111 may be driven by a conventional engine 110, such that the carrier element 112 is arranged to rotate with the said propeller axle 111.

Furthermore, the said drive point is eccentrically arranged on the carrier element 112, so that a rotation of the propeller axle 111 will drive the drive rod 121 back and forth (up and down in FIG. 1), in turn resulting in a reciprocal up and down motion of the flexible fluke 125, via the pivot element 114.

In order to keep the fluke 125 fixed to the same vertical plane during the full range of its reciprocal movement up and down, the pivot point 123 may be arranged to keep a constant angle of the pivot element 114 in relation to a vertical plane. This may, for instance, be accomplished by the pivot point 123 being supported across a sufficiently long horizontal stretch across the hull 101, possibly in combination with the pivot element 114 comprising oblique support beams connecting at different horizontal points to the pivot point 123.

With the fluke drive system described above, an existing drive system, comprising an existing engine 110 of a vessel, having an existing propeller axle 111, can be retrofitted for fluke propulsion in a way which is not only very cost-efficient, but also highly reliable in operation. Various possible details regarding such a drive system and such retrofit will be described in the following.

As can be seen in FIG. 1, the vessel 100 typically comprises a propeller axle 111 stabilizing element 113, such as a beam fastened to the hull 101 and extending to a point at which it rotationally receives and supports the propeller axle 101. Such stabilizing element 113 is hence conventional as such, but achieves the double purpose of stabilizing the propeller axle 111 and providing a support against which the lever formed by the pivot element 114 acts when the fluke 125 is raised and lowered. Preferably, the propeller axle 111 support element 113 is a previously existing propeller axle 111 support element 113, which is not modified in any way as a result of the retro-installation of a fluke drive system according to the present invention.

In some embodiments, the pivot element 114 is arranged in its entirety externally to said hull 101. This means that no hull 101 through holes must be, or are in fact, provided as a result of the mounting of said pivot element 114.

In particular, and as is illustrated in FIG. 1, the pivot element 114 is pivotally connected to the pivot point 123, such as comprising a bolt rotating in a through hole arranged externally to the hull 101, which pivot point 123 is welded to an external metal surface of said hull 101. Such a through hole may be arranged as a part of the pivot element 114 itself, or as a part that is permanently welded to the hull 101. Then, such a bolt may be arranged on the other part (hull 101 or pivot element 114, respectively).

The pivot element 114 itself may comprise, or be substantially comprised by, an elongate metal rod, such as a stainless steel rod with a smallest diameter of at least 10 cm.

In some embodiments, the driving mechanism is arranged, in its entirety, externally to said hull 101. This means that no moving part of the driving mechanism is arranged inside the hull 101, and in particular that no through holes are arranged as a part of an installation of the present driving mechanism on the vessel 100, for instance during a retro-installation on an existing vessel. It is realized, however, that a through hole for the propeller axle 111 is of course necessary, as well as any other through holes provided for different reasons than being part of the fluke drive system according to the present invention. Such already-existing through holes are hence not considered through holes being arranged as a part of an installation of the driving mechanism according to the invention. In other words, the retro-installation of the first aspect of the present invention may be undertaken without having to provide any additional through holes through the hull 101 of the vessel 100.

As illustrated in FIG. 1, the carrier element 112 may advantageously be fastened to an aft end of the propeller axle 111, and in particular to an already existing propeller fastening means, which propeller fastening means is then conventionally arranged to fasten a propeller to the propeller axle 111. However, the propeller fastening means may not support a propeller after retro-installation of the present fluke drive system, since it is instead connected to and supports the carrier element 112. Hence, the propeller axle 111 does in this case not support a propeller which would normally or previously have been attached to and supported by the propeller axle 111 for vessel 100 propulsion by rotation. To this end, the carrier element 112 may be specifically adapted with connection means, such as bolt holes of suitable dimension and placing, so as to be compatible with the existing propeller fastening means arranged on or as a part of the propeller axle 111.

Alternatively, the carrier element 112 may be permanently fastened to the propeller axle 111, such as welded thereto.

The carrier element 112 may be or comprise a metal disc, which disc may be substantially circular symmetric or of cylindrical shape, preferably with an axis of symmetry coaxial with a propeller axle 111 centre axis. In particular, the carrier element 112 may be fastened to or near (such as within at the most 1 meter of) an aft end surface of the propeller axle 111.

That the drive point 120 is arranged eccentrically to the propeller axle 111 means that the drive point 120 will describe a circular path of motion when being driven by the driving mechanism due to the propeller axle 111 rotating, which circular path of motion will be circular symmetric about a propeller axle 111 centre axis. It is understood that the said circular path of motion will have a non-zero, possibly constant, radius (the "excentre radius"), advantageously a radius of at least 0.1 m, more preferably of at least 0.5 m. The said radius may also be at the most 3.0 m.

In some embodiments, the carrier element 112 comprises an excentre radius adjustment means, arranged to be remote controlled to adjust said excentre radius of the drive point 120 in relation to the rotation axis of the propeller axle 111.

Figure 3:
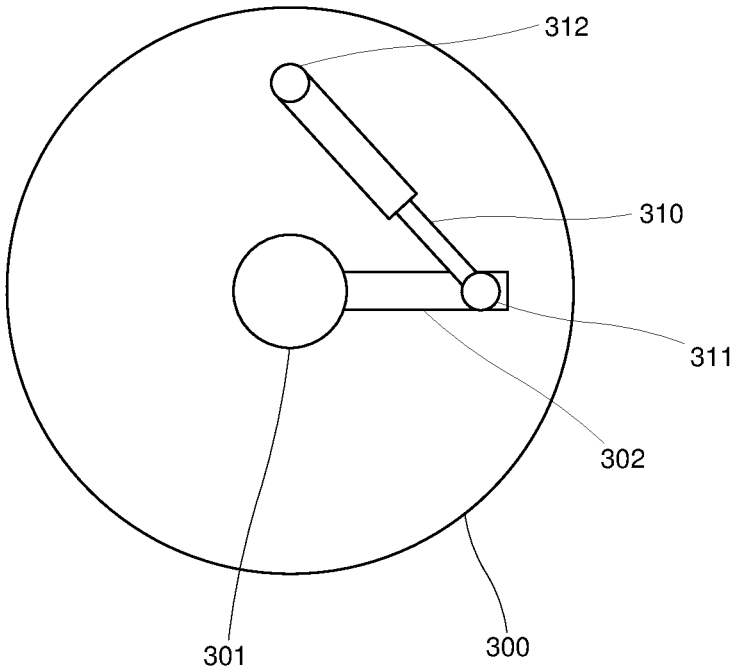
FIG. 3 is a simplified plan view of a carrier element according to the present invention, which carrier element in turn has a drive point.

FIG. 3 illustrates, in a simplified view as seen from the aft end of the vessel 100 looking forward, a carrier element 300 which may be used to this end. More particularly, the excentre radius adjustment means illustrated in FIG. 3 comprises a hydraulic cylinder (part of 310) connected at one point (312) to the carrier element 300 and at an opposite point (311) to the above-mentioned first end of the drive rod 121.

Hence, and as can be seen in this FIG. 3, the carrier element 300 may be concentrically oriented to the propeller axle 301. A track or guide 302 may be arranged in the carrier element 300, such as following a straight, possibly radial, path. A track following part 311 arranged at a distal end of an excentre radius adjustment hydraulic cylinder arrangement 310 may be arranged to be displaced along the track 302 in response to an activation of the arrangement 310, which activation hydraulically changes the length of the hydraulic cylinder in question. At an opposite, proximate end of the arrangement 310, a pivotal connection 312 to the carrier element 300 may be arranged, acting as a fixed point in relation to which the track following part 311 moves. Then, the above discussed drive point 120 is, or is attached to, the track following part 311.

As a consequence, the excentre radius of the drive point 120, in other words the distance between the drive point 120 and the propeller axle 301 centre axis, can be adjusted by hydraulically adjusting the length of the arrangement 310. Such hydraulic adjustment may be imparted remotely, such as using a control means provided at the captain's deck of the vessel 100 in turn connected to a suitably hydraulic pressure activation means connected to the arrangement 310.

By varying the said excentre radius, the stroke amplitude of the fluke 125 can be adjusted, hence affecting a propulsion power of the vessel 100. This is particularly an important feature when providing a drive system according to the present invention as a post-installation to an already existing vessel, having an already existing drive system comprising the engine 110 and the propeller axle 111. Namely, when such an existing propeller axle 111 is used for propulsion using the fluke 125, it may not always be desirable or possible to reach a full desired propulsion power interval merely by adjusting the engine 110 power. By alternatively or additionally adjusting the fluke 125 stroke amplitude, the possible control range in terms of propulsion power becomes more flexible. For instance, it is possible to adjust the propulsion power while maintaining the same propeller axle 111 rotation velocity.

In the embodiment illustrated in FIG. 3, and in other embodiments, the excentre radius adjustment means may be arranged to adjust the said excentre radius across an allowable excentre radius interval, such as a continuous interval. This excentre radius interval may be outwards limited, defining a maximum fluke 125 stroke amplitude. Such a maximum fluke amplitude may, in this first but also in the second aspect of the present invention described below, preferably be at least 0.1 meters, preferably at least 1 meters, and preferably at the most 20 meters, preferably at the most 10 meters. It is noted that the movement of a fluke 125; 229 connection point to the pivot element 114; 228 is substantially vertical (as a result of the longitudinal direction D length of the pivot element 114; 228 in relation to the stroke length of the drive rod 121; 224 and the location of the connection point 122; 226), and that it is this vertical movement to which the "fluke amplitude" mentioned herein refers.

Moreover, the said excentre radius interval may also comprise a point, such as an inner extreme point, at which the excentre radius is so small so that the fluke 125 is substantially not driven as a result of a rotation of the propeller axle 111. Hence, at this interval point, the fluke 125 stroke amplitude is substantially zero, so that the fluke 125 is substantially still even under rotation of the propeller axle 111. This provides a convenient way of turning off the fluke 125 propulsion without having to switch off the engine 110. In the case where the propeller axle 111 comprises a propeller in addition to the drive mechanism described here, this also provides a way of quickly and conveniently switching fluke 125 propulsion on and off, without having to switch propeller propulsion on or off at the same time.

Figure 2:
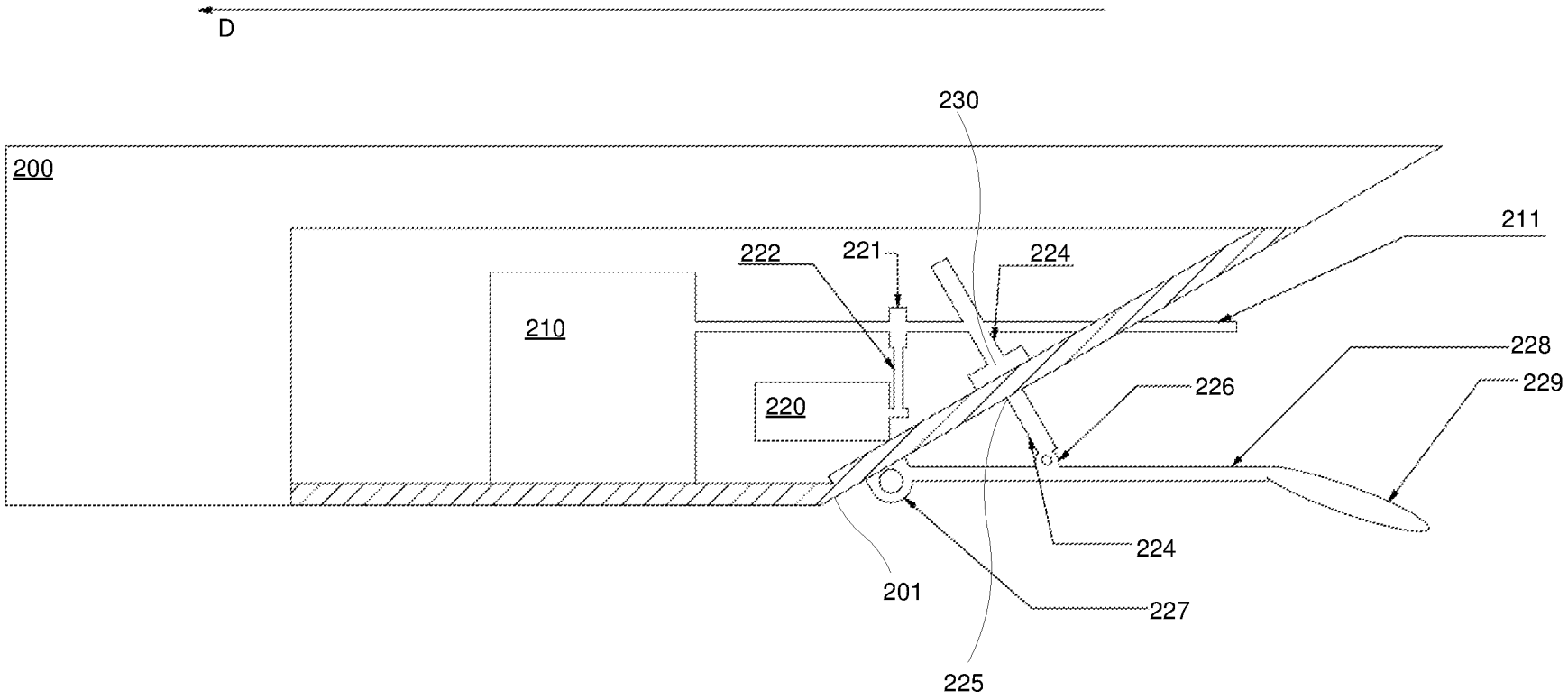
FIG. 2 is a simplified overview of a vessel having an exemplifying fluke drive system according to a second aspect of the present invention.

FIG. 2 illustrates a fluke drive system according to a second aspect of the present invention. The fluke drive system of FIG. 2, like the one illustrated in FIG. 1, is for a vessel 200 with a longitudinal direction D.

The fluke drive system comprises a pivot element 228, corresponding to pivot element 114 and having a forward end and an aft end. The pivot element 228 is pivotally connected at its forward end to the hull 201 of the vessel 200, and at its aft end to a flexible fluke 229, corresponding to fluke 125. The forward end of the pivot element 228 is connected to pivot point 227, corresponding to pivot point 123, welded to the hull 201 without requiring hull 201 penetrations.

The drive system of FIG. 2 also comprises a driving mechanism having a drive point 230, which driving mechanism is arranged to impart a reciprocal or rotary movement to the drive point 230.

The drive point 230 corresponds to drive point 120. As can be seen from FIG. 1, the drive point 120 describes a rotary movement when driven by the drive system, whereas in FIG. 2 the drive point 230 describes a linear, reciprocal movement when driven. This serves to show two different example of such reciprocal or rotary movement. However, in the drive system of FIG. 1 a linear, reciprocal movement can be used also, by providing a suitable lever system translating the rotary motion of the propeller axle 111 to a vertically oriented, linearly reciprocal movement of the drive point 120. Furthermore, in FIG. 2 a rotary drive point 230 movement can be provided by an inverse function, translating the linearly reciprocal movement of the hydraulic drive rod 224 (see below) to a rotating movement in a per se conventional manner. It is realized that there are many additional possibilities to achieve such linear or rotational movements of the drive points 120, 230.

The FIG. 2 drive system further comprises a drive rod 224, corresponding to drive rod 121, having a first end and a second end, which drive rod 224 is connected, at its first end, to the drive point 230, and at its second end to the pivot element 228. In particular, the said second end is connected to the pivot element 228 at a point 226 along the pivot element 228 between said forward and aft ends of the pivot element 228.

It is realized that in the second aspect illustrated by way of example in FIG. 2, the drive point 230 may be a part of the drive rod 224, being driven hydraulically back and forth. This way, the drive point 230 is "connected to" the drive rod 224 for forced reciprocal movement, in that the drive point 230 will be forcibly moved by the hydraulic pump 220 pressure, resulting in the entire drive rod 224 moving. Alternatively, one may in this case simply say that the hydraulic pump 220 hydraulically drives the drive rod 224 in a reciprocal manner.

So far, the drive system according to the first aspect is similar to the drive system according to the second aspect.

However, as is illustrated in FIG. 2, the driving mechanism in this second aspect comprises a hydraulic pump 220, arranged to be driven by the propeller axle 211 of the vessel 200, such that the force provided by the rotation of the propeller axle 211 is harvested and converted into a hydraulic pressure in the hydraulic pump 220.

Furthermore according to the second aspect, the said drive point 230 movement is achieved using said hydraulic pressure achieved by said hydraulic pump, so that a rotation of the propeller axle 211 will drive the drive rod 224 back and forth (upwards and downward in FIG. 2), in turn resulting in a reciprocal up and down motion of the flexible fluke 229 in a way corresponding to the above-described reciprocal up and down motion of the flexible fluke 125 described above.

The hydraulic pump 220 is arranged with a rotary energy conversion mechanism 221, such as a conventional gear/lever system, for converting said rotary energy from the propeller axle 211 into said hydraulic pressure as an overpressure to the hydraulic pump 220. Such conversion mechanism 221 is well-known in the art, and will not be described in detail herein.

The pump 220 may provide a hydraulic pressure to the drive point 230 (which may be a conventional hydraulic piston or plunger) for driving the drive rod 224. This hydraulic pressure may vary with the same frequency as the rotation frequency of the propeller axle 211. However, it may also vary according to a different frequency, which may be freely remote controlled by a user so as to vary a fluke 229 propulsion frequency and as a result possibly also propulsion power. Furthermore, the hydraulic pump 220 makes it possible to vary the stroke length of the drive rod 224 across an allowable interval corresponding to the above-described excentre radius interval. Such control may also take place in a remote controlled manner.

Hence, an existing engine 210, corresponding to engine 110, is used to propel the existing propeller axle 211, which in turn provides energy for the hydraulic pump 220 to build up a hydraulic pressure for propelling the fluke 229.

According to a preferred embodiment, the hydraulic pump 220 is completely arranged inside the interior of said hull 201. This provides for a less aggressive operation environment for the hydraulic pump 220, and also for simpler access to maintenance. However, the hydraulic pump 220 may also be arranged in its entirety externally to the hull 201, in which case no through hole must be provided in the hull 201 for accommodating the drive rod 224 (which is necessarily the case in the design illustrated in FIG. 2). It is particularly noted that the hydraulic pump 220 may convert the rotational energy from the propeller axle 211 from a point along the propeller axle 211 externally to the hull 201, and then drive the drive rod 224 (which is then also completely arranged externally to the hull 201) from a point also located outside of the hull 201.

As mentioned, the drive rod 224 itself may be hydraulically driven, such as directly driven by the hydraulic pressure supplied by the hydraulic pump 220 via suitable hydraulic conduits, and furthermore installed in and through a through hole 225 through the said hull 201.

Figure 5:
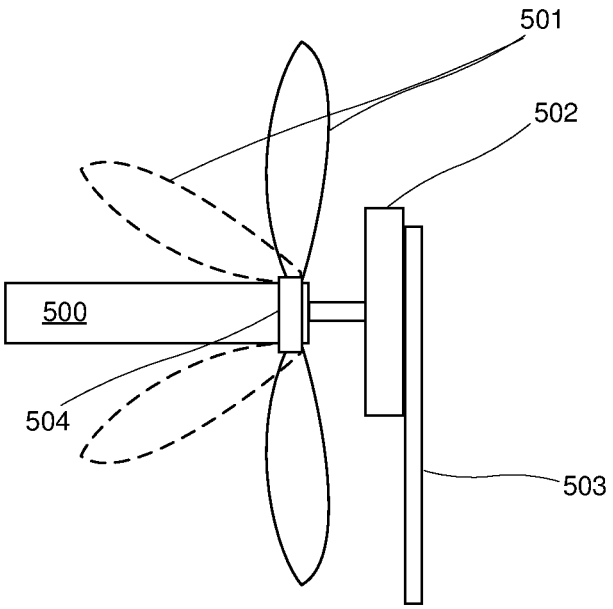
FIG. 5 is a simplified side view of a propeller axle and a foldable propeller.

As also mentioned above, the propeller axle 111; 211; 500 may also support a propeller. An example of such a configuration is illustrated in FIG. 5, where a propeller comprising propeller blades 501 is shown on the propeller axle 500. In this case, the propeller may comprise a remote controllable blade folding mechanism 504, arranged to allow a user to remotely control said propeller blades 501 to fold (broken lines) and unfold (full lines) so as to control the propelling power applied by the propeller in question. Such remote controlling may be imparted, for instance, in a way corresponding to the above-described hydraulically remote operated pivot element 114 amplitude control mechanism.

A foldable propeller can also be used as a backing function for a propeller axle connected to a fluke. In this case, the propeller blades are arranged to propel the vessel in an aft direction when the propeller axle in question rotates. Normally, when the fluke in question is driven for vessel forward propulsion, the propeller blades are folded in. however, when the vessel needs to back, the propeller blades are remotely folded out. Then, the propeller blades are designed so that they provide a backwards propulsion force which at least exceeds a forwards propulsion force as the fluke is moved up and down by the same propeller axle. To achieve this, the fluke stroke amplitude may temporarily be remotely adjusted down during such backing.

In FIG. 5, a carrier 502 with a drive rod 503 are also shown, corresponding to carrier 112 and drive rod 121, respectively. As is illustrated in FIG. 5, in this case the carrier 502 is arranged aft of the propeller, so that the drive rod 503 does not interfere with the propeller axle 500 as the latter rotates.

Also shown in FIG. 5, the propeller blades 501 are arranged to fold in a forward direction. However, it is realized that they may also be arranged to fold in an aft direction, depending on embodiment.

Figure 4:
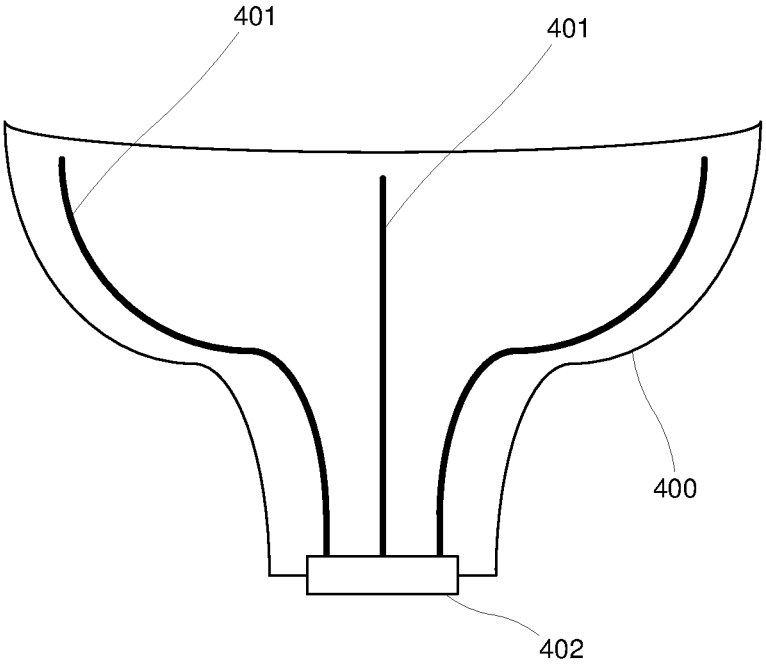
FIG. 4 is a simplified plan view of a first fluke according to the present invention with a fluke dynamic stiffening system.

FIG. 4 illustrates, in a top view, a fluke 400 of a type generally useful with the present invention. Hence, the fluke 400 corresponds to flukes 125; 229.

Preferably, the fluke 400 is made from a flexible solid (or partly hollow) material, such as a rubber or other polymer based material with sufficient durability yet offering flexibility for increased power transmission when used as described above, for propelling a vessel 100, 200 using reciprocal up- and down movements under water. Examples of suitable such materials comprise rubber, polyurethane and similar materials.

As is illustrated in FIG. 4, the fluke 400 may have flexible steel inserts 401 at one or several locations, such as extending along its periphery and/or its centreline. Such inserts 401 may, for instance, be made from spring steel. The inserts 401 may be removable and replaceable, for adjustment of the fluke 400 flex properties after installation. This may, for instance, be useful to adapt the properties of the fluke 400 after a change in vessel 100, 200 load or engine 110, 210.

In an alternative or additional embodiment, the fluke 400 comprises a remote controlled hydraulically or pneumatically operated, preferably passive, stiffening system 402. In this case, the reference numeral 401 does not denote steel inserts (as described above), but hydraulic or pneumatic channels. Then, the hydraulic or pneumatic channels 401 are arranged to make the fluke 400 stiffer as a result of a supplied higher hydraulic or pneumatic pressure to the channels 401 via the stiffening system 402, and vice versa. This will allow the vessel 100, 200 to dynamically alter the properties of the fluke 125; 229 in response to varying operation prerequisites.

It is realized that the stiffening system 402, as well as the above-described propeller folding system 504 and the remote fluke 125 amplitude adjustment system 310, may be provided with a suitable hydraulic pressure from a hydraulic pump such as the pump 220, or in any other way, and may be provided with remote control means such as remote controlled valves arranged inside the hull 101; 201 near the hydraulic pump in question for easy remote control action and maintenance.

As mentioned previously, the present invention is particularly well-suited for large vessels, such as tankers and freight ships. Preferably, the vessel is a larger PWC (Personal Water Craft), or even more preferably a cargo or freighter ship, and preferably has a DWT (DeadWeight Tonnage) of at least 5, preferably at least 100, more preferably at least 1,000, most preferably at least 10,000.

For such large vessels, it has previously turned out to be difficult to provide fluke propulsion in a cost-efficient and reliable way.

The large vessel 100; 200 may then comprise an internal engine 110; 210, such as a conventional ship diesel engine, arranged to drive the propeller axle 111; 211 at a maximum of 200 RPM, preferably at a maximum of 140 RPM. Then, it is very advantageous to allow the driving mechanism of the present system to be arranged to impart the above described reciprocal or rotary movement to the drive point 120; 230 at the same frequency as the rotation of the propeller axle 111; 211. This way, no gears or other mechanical means for rotational velocity adaptation are necessary, leading to a very simple, robust and reliable construction.

For such large vessels, and in particular for such slow propeller axle 111; 211 rotational frequencies, it is preferred that the pivot element 114; 228 is between 1 and 20 meters of length, and that the fluke has a horizontal projection surface of at least 0.5 $m^2$, preferably of at least 2 $m^2$, and at the most 100 $m^2$, preferably at the most 20 $m^2$. For large horizontal projection surfaces of at least 20 $m^2$, fluke swing frequencies of at the most 100 RPMs will typically be useful.

In case there are several propeller axles on the vessel 100; 200, each such propeller axle is preferably provided with a respective fluke each, with an individual fluke drive using the respective rotary motion of its respective propeller axle as an energy source.

Hitherto, the vessel 100, 200 has been described as a floating vessel. However, it is realized that the present invention can also be applied to submarine vessels, as long as the fluke is provided so that it can perform said reciprocal vertical motion entirely below the water surface.

Figure 6:
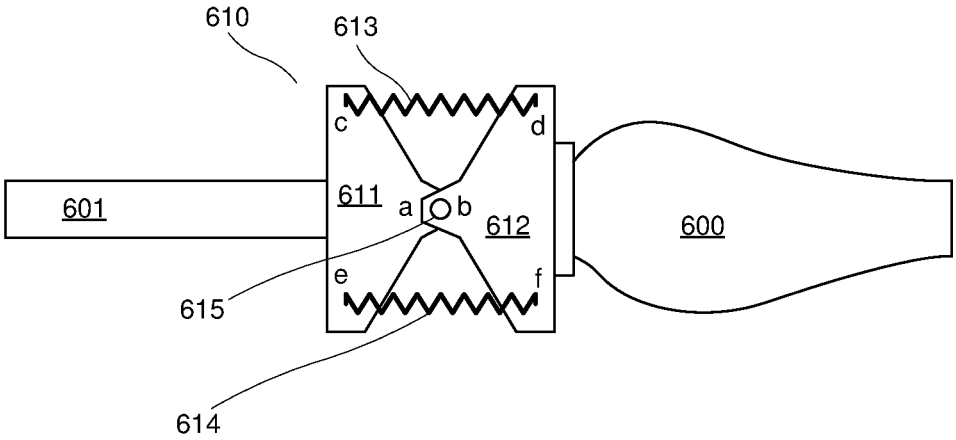
FIG. 6 is a perspective view of a second fluke according to the present invention.

FIG. 6 illustrates a third aspect of the present invention, namely a fluke 600 drive system comprising a fluke connecting part 610 constituting the connecting element between the pivot element 114; 228 and the fluke 125; 229. The fluke connecting part 610 is useful with the fluke drive systems according to the above-described first and second aspects, as well as with other fluke drive systems.

As described above, such a fluke drive system comprises a flexible fluke 600 and a fluke driving mechanism (not illustrated in detailed in FIG. 6) in turn comprising a displacement means 601 arranged to be driven to move reciprocally upwards and downwards. In FIG. 6, the displacement means 601 corresponds to the pivot element 114; 228 described above.

The fluke 600 is hence connected to the displacement means 601 via the fluke connecting part 610.

According to this third aspect of the present invention, the fluke connecting part 610 comprises a pivot joint 615, pivotally connecting a first point a of the displacement means 601 to a second point b of the fluke 600. In FIG. 6, this first point a is arranged on a first pivot part 611 of the fluke connecting part 610, which first pivot part 611, since it is rigidly connected to the displacement means 601, is considered part of the displacement means 601. The second point b is arranged on a second pivot part 612 of the fluke connecting part 610, and the second pivot part 612, since it is rigidly connected to the fluke 600, is similarly considered part of the fluke 600.

Hence, the first 611 and second 612 pivot parts are pivotally connected by the pivot joint 615; the first pivot part 611 is rigidly connected to the displacement means 601; and the second pivot part 612 is rigidly connected to the fluke 600. It is noted that the first a and second b points are those actually directly interconnected by the pivot joint 615, even though other points on the displacement means 601 and the fluke 600, respectively, are also interconnected in a pivoting manner. In particular, points a and b may both be aligned with a pivot axis of the pivot joint 615.

The fluke connecting part 610 further comprises an upper spring means 613, connecting a third point c of the displacement means 601 (and actually of the first pivot part 611) to a fourth point d of the fluke 600 (and of the second pivot part 612). The third point c is arranged above the first point a, while the fourth point d is arranged above the second point b. Preferably, the upper spring means 613 is located above the first a and second b points, such as entirely above these points a and b.

Similarly, the fluke connecting part 610 also comprises a lower spring means 614, connecting a fifth point e of the displacement means 601 (and the first pivot part 611) to a sixth point f of the fluke 600 (and the second pivot part 612). The fifth point e is arranged below the first point a, and the sixth point f is arranged below the second point b. Preferably, the lower spring means 614 is located below the first a and second b points, such as entirely below these points a and b.

Hence, the fluke 600 is suspended on the displacement means 601 via the pivot joint 615, allowing the fluke 600 to perform pivoting movements in a non-horizontal, preferably vertical or substantially vertical, plane. Preferably, the pivot joint 615 also limits the fluke 600 to only such movements. These pivoting movements will take place under the influence of spring forces from the said spring means 613, 614. These spring means 613, 614 may be configured so that they together are arranged to bring the fluke 600 to a relaxed state in which the fluke 600 is substantially vertically oriented, or somewhat slanting upwards in the aft direction. In this state, both spring means 613, 614 may be slightly stretched but counterbalancing each other. So in order to pivot upwards or downwards, the fluke 600 must stretch one of the spring means 613, 614 while pushing the other spring means towards a more relaxed state.

Furthermore, the spring means 613, 614 may together be configured so that a certain resistance must be overcome in order for the fluke 600 to pivot upwards, and a certain other resistance must also be overcome to pivot downwards from said relaxed state, so that the fluke 600 is brought back to the relaxed state when not affected by any external force.

Such a fluke 600 suspension has proven to provide excellent mechanical energy transfer efficiency in terms of transforming reciprocal vertical displacement means 601 movements to fluke 600 forwards propulsion power. The fluke connection part 610 will impart a "wavy" type movement of the fluke 600 as a result of an upwards/downwards reciprocal movement of the displacement means 601, which hence leads to high propulsion energy efficiency.

In preferred embodiments, the said pivot joint 615, the upper spring means 613 and the lower spring means 614 are the only mechanical connections between the displacement means 601 to which the fluke 600 is connected and the fluke 600 itself. In particular, these connections 613, 614, 615 may be the only mechanical connections affecting the mechanical behaviour of the fluke 600 in relation to the fluke driving mechanism.

The spring means 613, 614 may both be tension springs, such as coil springs made from stainless spring steel. They may also be gas springs with corresponding properties. There may also be several upper and/or lower spring means, of the same or different types, as long as the basic properties described herein of the fluke connecting part 610 are achieved.

In some embodiments, the spring constant of the upper spring means 614 is larger, such as at least twice, the spring constant of the lower spring means 613. This results in that it will require more force to pivot (about point 615) the fluke 600 downwards than upwards, affecting how the fluke 600 moves in the water when being pushed (by the displacement means 601) upwards and downwards. In general, the fluke 600 will, when moving up and down in the water, have a smaller downwards pivot angle (about point 6015, achieved by the fluke pressing water upwards) in relation to the horizontal when being pushed with a certain vertical force upwards by the displacement means 601, and with a larger corresponding upwards pivot angle to the horizontal when being pushed with an equal vertical force downwards by the displacement means 601. Such movement pattern has proven to provide a very efficient energy transfer, as well as minimized non-desired vessel 100, 200 up/down movements, for forward fluke 600 propulsion in water.

In some embodiments, the fluke is freely movable, against the spring force of said spring means 613, 614 across an angular interval of ±70° in relation to the horizontal.

The said first a, third c and fifth e points may all be rigidly connected to each other, such as via the first pivot part 611. Similarly, the second b, fourth d and sixth f points may all be rigidly connected to each other, such as via the second pivot part 612.

Using a fluke drive of the type described herein to propel a vessel may provide a propulsion power which may not correspond to an existing or standard rudder of the vessel. This is particularly the case where an existing engine 110; 210 is used with a retrofitted fluke drive system as described herein, and further particularly in cases where an existing propeller is to be used together with such a retro-installed fluke drive system.

Figure 7:
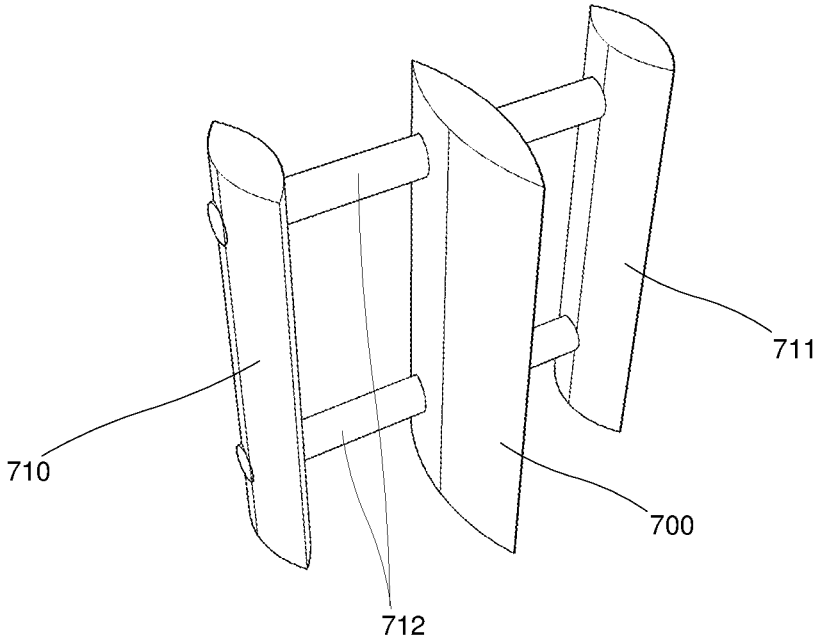
FIG. 7 is a simplified perspective view of a rudder aggregate according to the invention.

To this end, in some embodiments the vessel 100; 200 may further be retrofitted with a rudder aggregate such as the one illustrated in FIG. 7. In this case, the fluke drive system according to the invention comprises, in addition to a previously existing main rudder 700, also one or several additional rudders 710, 711, fastened in parallel to the main rudder 700 on either sides of said main rudder 700, such as via two or more retro-installed beams 712. The additional rudders 710, 711 are then connected to a previously existing rudder steering mechanism, such as via a direct mechanical connection to the main rudder 700, so that they are moved in concert with the main rudder 700 such that they will always be arranged substantially in parallel to the main rudder 700 when a user controls the main rudder 700 via the conventional and existing vessel steering mechanism.

Preferably, the additional rudders 710, 711 may be locally connected to the main rudder 700 so as to be forced to move in a corresponding manner as the main rudder moves 700. Such a local connection may be via said beams 712. It is realized that FIG. 7 is simplified, but one of ordinary skill in the art will be able to design a suitable lever system to achieve such controlled movement of the additional rudders 710, 711. Furthermore, the additional rudders 710, 711 may be smaller, such as not extending as far in the aft direction, as the main rudder 700, and they may also be arranged symmetrically on either side in relation to the main rudder 700.

Figure 8:
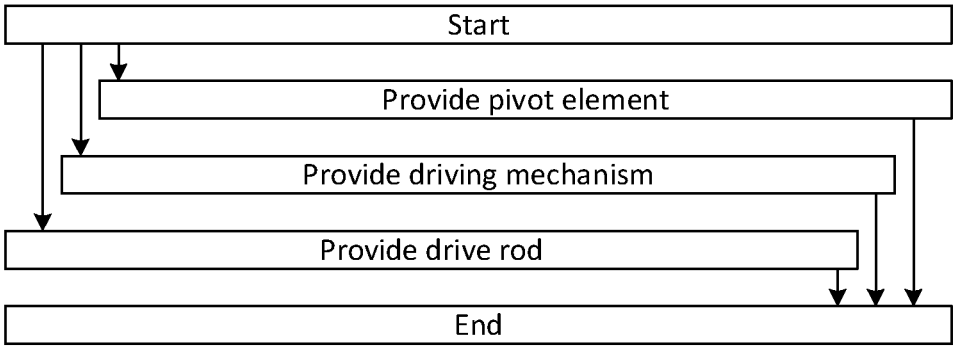
FIG. 8 is a flowchart illustrating a method according to the invention.

FIG. 8 is a flow chart illustrating a method according to the present invention, for retrofitting a vessel 100; 200 with a fluke drive system of the type described above.

In a first step, the method starts.

In a different step, the pivot element 144; 228 is provided to the vessel 100; 200, the pivot element 144; 228 having a forward end and an aft end, as described above, and being connected at the aft end to the flexible fluke 125; 229. This pivot element 144; 228 provision step also includes connecting the pivot element 123; 227 at the said forward end to the hull 101; 201 of the vessel 100; 200.

In a different step, the driving mechanism is provided, which driving mechanism has said drive point 120; 230. As described above, said driving mechanism is provided for imparting a reciprocal or rotary movement to the drive point 120; 230 in question.

In case a drive system according to the first aspect is installed, this driving mechanism provision step also comprises the carrier element 112 being fastened to the existing propeller axle 111 of the vessel 100 so that the carrier element 112 rotates with the said propeller axle 111. Further in a retro-installation according to said first aspect, in this same driving mechanism provision step, the said drive point 120 is also eccentrically arranged on the carrier element 112 so that a rotation of the propeller axle 111 will drive the drive rod 121 back and forth as described above, in turn resulting in a reciprocal up and down motion of the flexible fluke 125.

If, on the other hand, a drive system according to the said second aspect is being retro-installed, the driving mechanism provision step may instead comprise providing the hydraulic pump 220, arranged to be driven by the propeller axle 211 of the vessel 200; and the same step may also comprise installing the hydraulic pump 220 so that a hydraulic pressure achieved by the hydraulic pump 220 in turn achieves said movement of the drive point 230 as described above, so that a rotation of the propeller axle 211 will drive the drive rod 224 back and forth, in turn resulting in a reciprocal up and down motion of the flexible fluke 229.

In a different step, the drive rod 121, 224 is provided, having a first end and a second end as described above. This step includes connecting the drive rod 121; 224 at the first end to the drive point and at the second end to the pivot element 123; 227. More particularly, the said second end of the drive rod 121; 224 is connected to the pivot element 123; 227 at a point along the pivot element 123; 227 between said forward and aft ends of the pivot element 114; 228, as described above.

At a subsequent step, the method ends. It is realized that the above intermediate steps may be taken in any order, or simultaneously.

It is realized that additional steps may also be comprised in such a retro-installation method, including installing an excentre radius adjustment means 310; adjusting the size, shape and properties of the fluke 400, including providing it with metal inserts 401 and/or a hydraulic stiffening system of the above described type; providing the fluke 600 with a fluke connecting part 610 of the above described type; and installing additional rudders 710, 711 of the type illustrated in FIG. 7. All these steps are then performed in accordance with that which has been described above.

Furthermore, the retro-installation method may comprise installing several fluke drive systems on the same vessel 100; 200, driving several flexible flukes of the above described types; or installing at least one fluke drive system of the above described type arranged to drive several flukes on the same vessel 100; 200. For instance, one single hydraulic pump 220 may be arranged to provide hydraulic pressure to impart movement to several drive rods 224, each moving a respective pivot element 228 with a respective fluke 229. Also, on one and the same vessel 100; 200, fluke drive systems according to both the first and the second aspects may be installed concurrently.

It is highly preferred that the vessel 100; 200 in question is of the above described, large, type, and that the installation is a true retro-installation. This means that the engine 110; 210 is an existing propulsion engine of the vessel in question 100; 300, and also that the propeller axle 111; 211 is an existing propeller axle driven by the engine 110; 210 in question. It is preferred that no additional propeller axle support beams in addition to existing ones 113 are retro-installed.

The retro-installation method may also comprise a remote control connecting step, in which remote control means, such as control cabling or control hydraulics, are installed so as to allow a user to remote control the retro-installed functionality as described above. Such remote controlling may, for instance, then take place from the captain's bridge.

Above, preferred embodiments have been described. However, it is apparent to the skilled person that many modifications can be made to the disclosed embodiments without departing from the basic idea of the invention.

For instance, the vessel may be of many different types, and it may also comprise additional means of propulsion than those described herein.

In FIGS. 1 and 2, the pivot element 114; 228 is arranged vertically below the propeller axle 111; 211. Although this is typically the case, it is realized that the pivot element 114; 228 may also be arranged vertically above the propeller axle 111; 211.

All which has been said in relation to the respective fluke drive systems of the first, second and third aspects, including what has been said regarding individual component parts of these systems, are equally applicable to the other aspects of the invention, as far as they are compatible. Furthermore, all which has been said in relation to the installation methods is equally applicable to the corresponding fluke drive system, and vice versa.

Hence, the invention is not limited to the described embodiments, but can be varied within the scope of the enclosed claims.

The invention claimed is:

1. A fluke drive system for a vessel, comprising:

a pivot element having a forward end and an aft end, which pivot element is pivotally connected at the forward end to a hull of the vessel and which pivot element is connected at the aft end to a flexible fluke;

a driving mechanism having a drive point, which driving mechanism is arranged to impart a reciprocal or rotary movement to the drive point; and a drive rod having a first end and a second end, which drive rod is connected at the first end to the drive point and at the second end to the pivot element, wherein the driving mechanism comprises a carrier element fastened to a propeller axle of the vessel and being arranged to rotate with the said propeller axle, and wherein the said drive point is eccentrically arranged on the carrier element so that a rotation of the propeller axle will drive the drive rod back and forth, in turn resulting in a reciprocal up and down motion of the flexible fluke, and wherein said second end of the drive rod is connected to the pivot element at a point along the pivot element between said forward and aft ends, and in that the pivot element is arranged in its entirety externally to said hull and pivotally connected to a pivot point which is welded to the said hull.

2. The fluke drive system according to claim 1, wherein the driving mechanism is in its entirety externally arranged to said hull.

3. The fluke drive system according to claim 1, wherein the carrier element is fastened to a propeller fastening means, which propeller fastening means is arranged to fasten a propeller to the propeller axle, and wherein the propeller axle does not support a propeller.

4. The fluke drive system according to claim 1, wherein the propeller axle supports a propeller, and wherein the propeller comprises a remote controllable blade folding mechanism arranged to allow a user to control said propeller blades to fold and unfold so as to control the propelling power applied by the propeller.

5. Fluke drive system according to claim 1, wherein the carrier element comprises an excentre radius adjustment means, arranged to be remote controlled to adjust an excentre radius of the drive point in relation to the rotation axis of the propeller axle.

6. The fluke drive system according to claim 5, wherein the excentre radius adjustment means comprises a hydraulic cylinder connected at one point to the carrier element and at an opposite point to the first end of the drive rod.

7. The fluke drive system according to claim 5, wherein the excentre radius adjustment means is arranged to adjust the excentre radius across an allowable excentre radius interval, which interval comprises a point at which the excentre radius is so small so that the flexible fluke is substantially not driven as a result of a rotation of the propeller axle.

8. The fluke drive system according to claim 1, wherein the fluke is made from a flexible material, preferably having flexible steel inserts along its periphery.

9. The fluke drive system according to claim 8, wherein the fluke comprises a remote controlled hydraulically or pneumatically operated stiffening system arranged to make the fluke stiffer as a result of a supplied higher hydraulic or pneumatic pressure to the stiffening system.

10. The fluke drive system according to claim 1, wherein the driving mechanism comprises a displacement means, which displacement means is arranged to be driven to move reciprocally upwards and downwards by the driving mechanism, wherein the fluke is connected to the displacement means via a fluke connecting part, wherein the fluke connecting part comprises a pivot joint, pivotally connecting a first point of the displacement means to a second point of the fluke;

an upper spring means connecting a third point, arranged above the first point, of the displacement means to a fourth point, arranged above the second point, of the fluke; and a lower spring means, connecting a fifth point, arranged below the first point, of the displacement means to a sixth point, arranged below the second point, of the fluke.

11. The fluke drive system according to claim 1, wherein the vessel is a cargo or freighter ship, preferably of at least 10,000 DWT.

12. The fluke drive system according to claim 1, wherein the vessel comprises an internal engine arranged to drive the propeller axle at a maximum of 200 RPM.

13. The fluke drive system according to claim 1, wherein the driving mechanism is arranged to impart said reciprocal or rotary movement to the drive point at the same frequency as the rotation of the propeller axle.

14. The fluke drive system according to claim 1, wherein system further comprises one or several additional rudders, fastened in parallel to a main rudder on either sides of said main rudder.

15. A method for retrofitting a vessel with a fluke drive system, which method comprises the steps:

providing to the vessel a pivot element having a forward end and an aft end and being connected at the aft end to a flexible fluke, including connecting the pivot element at the forward end to a hull of the vessel;

providing a driving mechanism having a drive point, which driving mechanism is arranged to impart a reciprocal or rotary movement to the drive point; and providing a drive rod having a first end and a second end, including connecting the drive rod at the first end to the drive point and at the second end to the pivot element, wherein, in the said driving mechanism provision step, a carrier element is fastened to a propeller axle of the vessel so that it rotates with the said propeller axle, and wherein, in that, also in said driving mechanism provision step, the said drive point is eccentrically arranged on the carrier element so that a rotation of the propeller axle will drive the drive rod back and forth, in turn resulting in a reciprocal up and down motion of the flexible fluke, and wherein that the second end is connected to the pivot element at a point along the pivot element between said forward and aft ends, and in that the pivot element is arranged in its entirety externally to said hull and pivotally connected to a pivot point which is welded to the said hull.

* * * * *